US011731185B2

(12) United States Patent
Shinmiya et al.

(10) Patent No.: US 11,731,185 B2
(45) Date of Patent: Aug. 22, 2023

(54) METHOD FOR MANUFACTURING PRESSED COMPONENT

(71) Applicant: JFE Steel Corporation, Tokyo (JP)

(72) Inventors: Toyohisa Shinmiya, Tokyo (JP); Yuji Yamasaki, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 0 days.

(21) Appl. No.: 17/057,306

(22) PCT Filed: May 22, 2019

(86) PCT No.: PCT/JP2019/020318
§ 371 (c)(1),
(2) Date: Nov. 20, 2020

(87) PCT Pub. No.: WO2019/225661
PCT Pub. Date: Nov. 28, 2019

(65) Prior Publication Data

US 2021/0316352 A1 Oct. 14, 2021

(30) Foreign Application Priority Data

May 24, 2018 (JP) ..... 2018-099807
May 24, 2018 (JP) ..... 2018-099808

(51) Int. Cl.
*B21D 22/02* (2006.01)
*B21D 37/10* (2006.01)

(52) U.S. Cl.
CPC ..... *B21D 22/02* (2013.01); *B21D 37/10* (2013.01)

(58) Field of Classification Search
CPC ..... B21D 22/02; B21D 22/06; B21D 22/20; B21D 22/22; B21D 22/00; B21D 22/26;
(Continued)

(56) References Cited

U.S. PATENT DOCUMENTS

2005/0262917 A1* 12/2005 Osumi ..... B21D 5/00 72/379.2
2006/0137422 A1* 6/2006 Kodaka ..... B21D 24/04 72/350

(Continued)

FOREIGN PATENT DOCUMENTS

CN 1796018 A 7/2006
CN 101522334 A 9/2009

(Continued)

OTHER PUBLICATIONS

Extended European Search Report for European Application No. 19 806 798.5, dated Jul. 5, 2021, 10 pages.

(Continued)

*Primary Examiner* — Katrina M Stransky
*Assistant Examiner* — P Derek Pressley
(74) *Attorney, Agent, or Firm* — RatnerPrestia

(57) ABSTRACT

A material is press formed into a component shape including a top sheet portion including a curved outer peripheral edge portion curved in such a manner as to be recessed inward, a vertical wall portion, and a flange portion. When a lower die and a pad sandwich a sandwiching region that is a region including at least a part of a region corresponding to the top sheet portion, an upper die is moved in a pressing direction to perform bending while moving the sandwiched material to the vertical wall portion side. A surface of the lower die that sandwiches the sandwiching region is provided with one or more ridgelines for forming bends. The ridgelines are set at positions such that, when the bending is complete, the position of the top sheet portion is located on the vertical wall portion side rather than the positions of the ridgelines.

18 Claims, 12 Drawing Sheets

(58) Field of Classification Search
CPC ..... B21D 24/04; B21D 35/005; B21D 37/10; B21D 37/02; B21D 53/88
See application file for complete search history.

(56) References Cited

U.S. PATENT DOCUMENTS

| | | | |
|---|---|---|---|
| 2008/0184764 | A1 | 8/2008 | Nakamura et al. |
| 2010/0018280 | A1 | 1/2010 | Maeda et al. |
| 2012/0297853 | A1 | 11/2012 | Tanaka et al. |
| 2016/0199897 | A1 | 7/2016 | Otsuka et al. |

FOREIGN PATENT DOCUMENTS

| | | | | |
|---|---|---|---|---|
| CN | 105592950 | A | 5/2016 | |
| EP | 2644293 | A1 * | 10/2013 | ..... B21D 22/02 |
| EP | 2644293 | A1 | 10/2013 | |
| EP | 2946849 | A1 | 11/2015 | |
| EP | 3278897 | A1 | 2/2018 | |
| FR | 3046734 | A1 * | 7/2017 | ..... B21D 19/08 |
| JP | 5166429 | B2 | 3/2013 | |
| JP | 2016203214 | A | 12/2016 | |
| WO | 2017002253 | A1 | 1/2017 | |

OTHER PUBLICATIONS

International Preliminary Report on Patentability for International Application No. PCT/JP2019/020318, dated Nov. 24, 2020, 6 pages.
International Search Report and Written Opinion for International Application No. PCT/JP2019/020318, dated Aug. 13, 2019, 5 pages.
Chinese Office Action for Chinese Application No. 201980033855.5, dated Feb. 24, 2022, with Concise Statement of Relevance of Office Action, 10 pages.
Chinese Office Action for Chinese Application No. 201980033855.5 dated Jul. 20, 2022 with Concise Statement of Relevance of Office Action, 10 pages.
Automotive Body Manufacturing Technology, Sep. 30, 2006 with translation, 10 pages.
Chinese Office Action for Chinese Application No. 201980033855.3, dated Jul. 20, 2022 with Concise Statement of Relevance of Office Action, 20 pages.

* cited by examiner

METHOD FOR MANUFACTURING PRESSED COMPONENT

CROSS REFERENCE TO RELATED APPLICATIONS

This is the U.S. National Phase application of PCT/JP2019/020318, filed May 22, 2019, which claims priority to Japanese Patent Application No. 2018-099807, filed May 24, 2018 and Japanese Patent Application No. 2018-099808, filed May 24, 2018, the disclosures of each of these applications being incorporated herein by reference in their entireties for all purposes.

FIELD OF THE INVENTION

The present invention relates to a technology for manufacturing a press-formed component having a component shape such as, for example, an L shape or a T shape in a top view. The above component shape includes atop sheet portion including a curved outer peripheral edge portion curved in such a manner that a part of an outer peripheral edge is recessed inward, a vertical wall portion continuous with the curved outer peripheral edge portion, and a flange portion continuous with the vertical wall portion and bent toward the top sheet portion side. In particular, the present invention is a technology suitable for manufacturing vehicle body frame components for automobiles.

BACKGROUND OF THE INVENTION

Examples of the vehicle body frame components for automobiles include a front pillar reinforcement and a center pillar reinforcement. These vehicle body frame components often have a shape curved in such a manner that a part of the top sheet portion is recessed inward, such as an L shaped portion or a T shape portion. When manufacturing a component having such a component shape from a flat metal sheet (blank material) by press forming, drawing or bending is commonly adopted.

However, frame components as mentioned above have great influence on collision safety of automobiles. Therefore, in recent years, such components have tended to be manufactured using high strength steel sheets (high tensile strength materials) having a tensile strength of 980 MPa or more. When press forming such high tensile strength materials having low ductility, a pad bending-based method is often adopted to avoid cracking.

A die for use in bending-based forming methods generally includes a die (lower die), a punch (upper die), and a pad for stabilizing a blank material during forming. However, stretch flange cracking that occurs at a flange end of the curved portion is frequently problematic even in the above-mentioned bending-based forming.

Manufacturing methods disclosed in PTL 1 and PTL 2 are examples of a technology for avoiding such stretch flange cracking.

In the method disclosed in PTL 1, an L-shaped component is manufactured by pressurizing a blank material by a pad in a state where an end portion of a portion corresponding to a lower side of the L shape of the blank material is in the same plane as the top sheet portion of a product, and, in this state, performing bending by an upper die.

The method disclosed in PTL 2 performs bending of a vertical wall portion and a flange portion after forming a linear bead extending along a transverse end portion and steps on a blank material.

PATENT LITERATURE

PTL 1: JP Pat. No. 5168429
PTL 2: JP 2016-203214 A

SUMMARY OF THE INVENTION

In the method disclosed in PTL 1, the blank material at the position of the top sheet portion in the curved portion moves in an in-plane direction under the pad during bending, thereby improving the stretch flange cracking in the curved portion. However, the moving amount and the moving rate of a portion sandwiched by the die (lower die) and the pad during the forming are governed by a frictional force between the die (the pad or the punch) and the blank material. Thus, when mass production is performed by the method disclosed in PTL 1, the moving amount fluctuates depending on a change in the state of a die surface caused by wear of the die or a change in the state of an oil coat on a material surface. Thus, it is difficult to deal with sporadic stretch flange cracking that occurs due to fluctuation in the moving amount.

Additionally, the method disclosed in PTL 2 requires steps of forming the bead and the steps on the blank material (metal sheet) prior to main forming, which increases cost. Furthermore, the product may have surface defects due to passage through protrusions formed by the bead and the steps in the main forming.

Aspects of the present invention have been made in view of the problem as described above. It is an object according to aspects of the present invention to provide a technology capable of simply and more stably suppressing stretch flange cracking in a curved portion.

To deal with the above problem, the present inventors conducted intensive and extensive studies to manufacture a component including a curved portion recessed toward a top sheet portion in a top view, such as an L- or T-shaped component, at low cost without causing sporadic stretch flange cracking even with use of a high tensile strength material as a metal sheet material. As a result, the present inventors found that the above problem can be solved by performing bending of a vertical wall portion and a flange portion by bending-based forming using a pad in such a manner as to move a metal sheet portion sandwiched by a lower die and the pad to the vertical wall portion side while applying a fold line (an out-of-plane deformation having a mountain-shaped cross section) on the metal sheet portion by the sandwiching.

Specifically, to solve the problem, an aspect of the present invention is a method for manufacturing a press-formed component, which manufactures the press-formed component by press forming a metal sheet into a component shape including a top sheet portion including a curved outer peripheral edge portion curved in such a manner that a part of an outer peripheral edge is recessed inward, a vertical wall portion continuous with the curved outer peripheral edge portion of the top sheet portion, and a flange portion continuous with the vertical wall portion and bent toward the top sheet portion side, the method including: in a state where a lower die and a pad sandwich a sandwiching region that is a region including at least a part of a region corresponding to the top sheet portion in the metal sheet, moving an upper die relatively with respect to the lower die in a pressing direction to perform bending of the vertical wall portion and the flange portion while moving at least a part of a material of the sandwiching region sandwiched by the lower die and the pad to the vertical wall portion side, in which during the bending, as the material is moved, out-of-plane bending and unbending deformations are continuously applied to the metal sheet region sandwiched by the lower die and the pad at a position of a bend portion extending in a direction intersecting with a moving direction of the material to control the movement of the material.

According to aspects of the present invention, for example, even when a high tensile strength material is used as a metal sheet material, a simple change in die structure enables a component including a curved portion recessed toward a top sheet portion in a top view, such as an L-shaped component or a T-shaped component, to be manufactured with further reduced sporadic stretch flange cracking.

DETAILED DESCRIPTION OF EMBODIMENTS OF THE INVENTION

Next, embodiments of the present invention will be described with reference to the drawings.

Here, the drawings are schematic, and relationships between thicknesses and planar dimensions, thickness ratios between respective layers, and the like are different from actual ones. Additionally, the following embodiments exemplify structures for embodying the technological idea of the present invention, and the technological idea of the present invention is not to be construed as limiting materials, shapes, structures, and the like of the components to those below. The technological idea of the present invention may be modified in various ways within the technological scope defined by the appended claims.

First Embodiment

First, a first embodiment based on the present invention will be described.

A method for manufacturing a press-formed component 1 of the present embodiment is a method for manufacturing the press-formed component 1, which manufactures the press-formed component 1 by press forming a metal sheet (referred to also as blank material) into a previously set press-formed shape. The set press-formed shape is a component shape (see FIG. 1) including a top sheet portion 2 including a curved outer peripheral edge portion 2*a* curved in such a manner that a part of an outer peripheral edge is recessed inward, a vertical wall portion 3A continuous with the curved outer peripheral edge portion 2*a* of the top sheet portion 2, and a flange portion 4A continuous with the vertical wall portion 3A and bent toward the top sheet portion 2.

The method for manufacturing the press-formed component 1 of the present embodiment is a technology that is suitable when the metal sheet is a high tensile strength steel sheet having a tensile strength of 590 MPa or more, preferably 780 MPa or more.

Figure 1A:
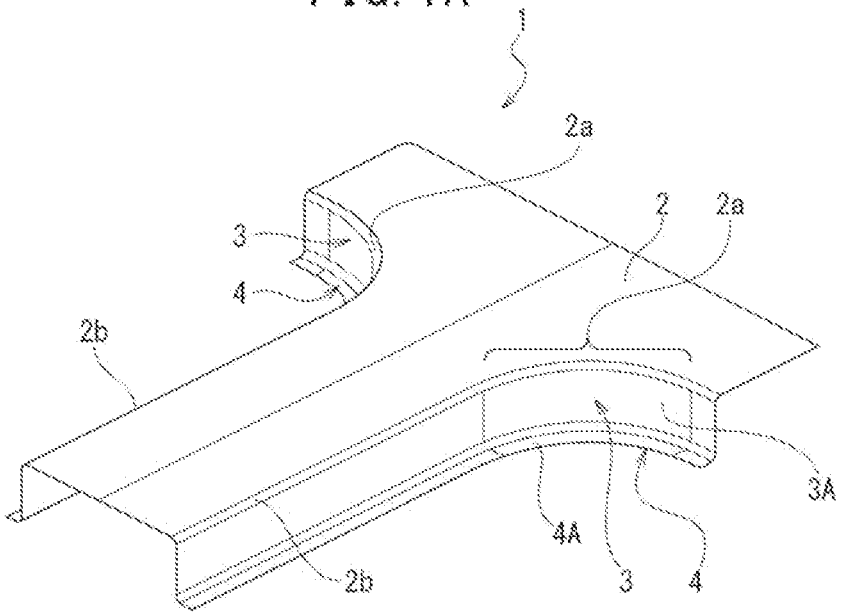
FIG. 1 is a perspective view illustrating examples of the shape of a component.

The press-formed component 1 that is the subject of the present embodiment has the component shape including the curved portion (the curved outer peripheral edge portion 2*a*) recessed toward the top sheet portion 2 in a top view, such as, for example, a T-shaped component or an L-shaped component, as illustrated in FIG. 1. In the examples of FIG. 1, the press-formed component 1 has a shape in which the vertical wall portion 3 is also continuous with a linear outer edge portion 2*b* other than the curved outer peripheral edge portion 2*a* in the top sheet portion 2.

The method for manufacturing the press-formed component 1 of the present embodiment manufactures the press-formed component 1 by bending-based press forming. A press forming die for use in the press forming of the present embodiment includes an upper die 40 (bending die), a lower die 20 (punch), and a pad 30 (see FIGS. 6 and 7).

Additionally, in the method for manufacturing the press-formed component 1 of the present embodiment, when bending the vertical wall portion 3A continuous with the curved outer peripheral edge portion 2*a* of the top sheet portion 2 and the flange portion 4A continuous with the vertical wall portion 3A and bent toward the top sheet portion 2, a sandwiching region P that is a region including at least a part of a region corresponding to the top sheet portion 2 in the metal sheet is sandwiched by the lower die 20 and the pad 30. Then, by moving the upper die 40 relatively with respect to the lower die 20 in a pressing direction, the vertical wall portion 3 and the flange portion 4 are bent into a desired component shape while moving the material of the sandwiching region P sandwiched by the lower die 20 and the pad 30 to the vertical wall portion 3 side.

Figure 5:
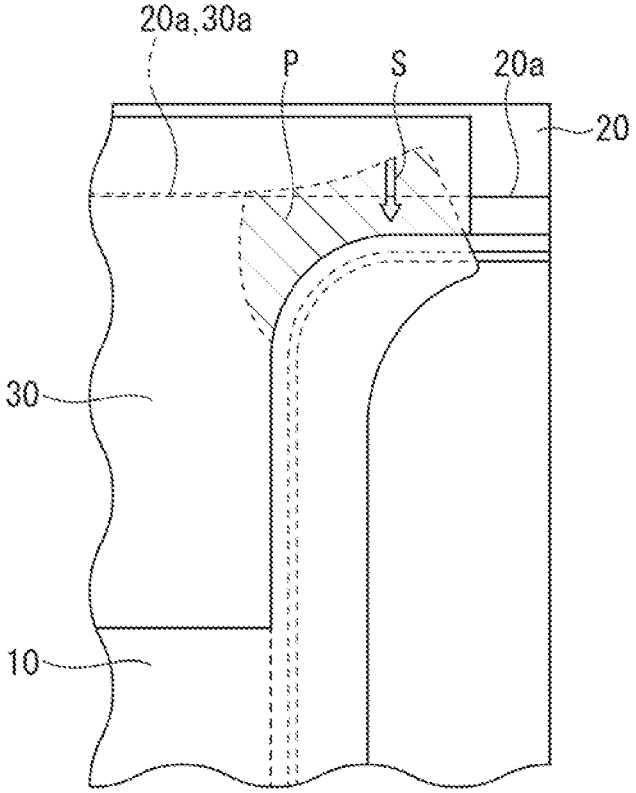
FIG. 5 is a plan view illustrating an example of a relationship between a metal sheet according to the first embodiment based on the present invention and a pad.
Figure 7A:
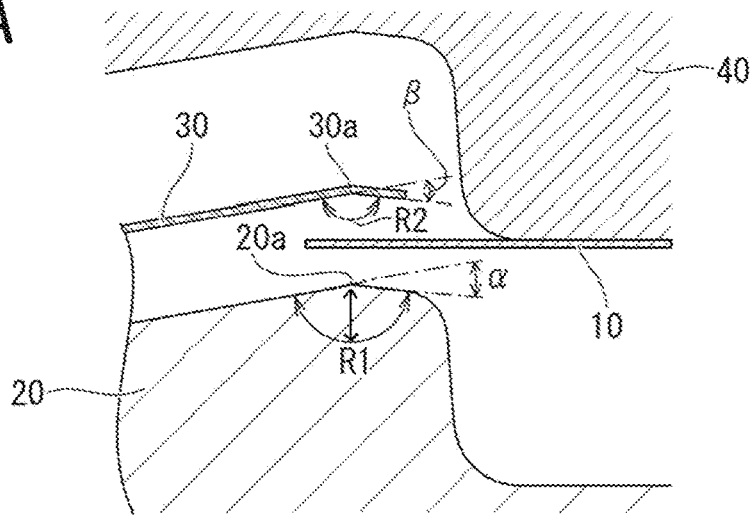
FIG. 7 is a diagram illustrating bending at a position B-B of FIG. 3 in the first embodiment based on the present invention.
Figure 7B:
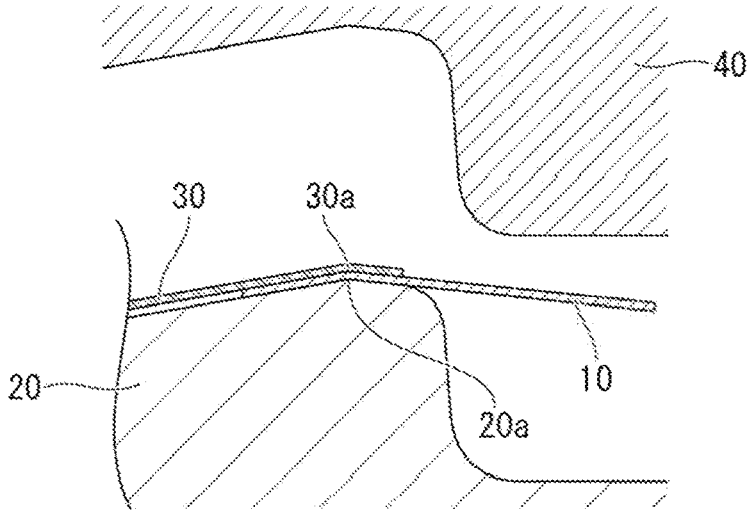
Figure 7C:
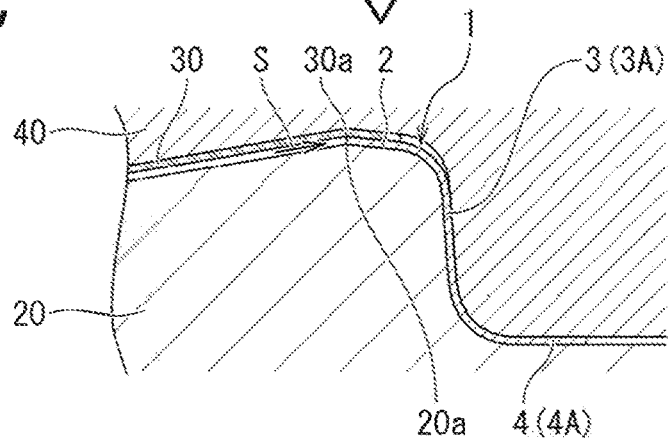

A surface of the lower die 20 (a surface portion facing the pad 30) that sandwiches the above sandwiching region P is provided with one or more ridgelines 20*a* extending in a direction intersecting with a moving direction S of the material (see FIGS. 5 and 7). The surface of the lower die 20 has different surface inclinations on both sides of each ridgeline 20*a*.

Movement of the material mainly occurs on a side where a distance from the curved outer peripheral edge portion 2*a* to an end portion of the metal sheet 10 is smaller. Additionally, in the case of a component shape as in FIG. 3, movement of the material to the vertical wall portion side occurs during bending even at a vertical wall portion position continuous with a linear outer edge portion continuous with a right side (the right side on the drawing sheet surface) of the curved outer peripheral edge portion 2*a*.

Due to this, the ridgeline 20*a* is arranged on the side where the distance from the curved outer peripheral edge portion 2*a* to the end portion of the metal sheet 10 is smaller.

A difference (hereinafter referred to also as fold angle α) between the surface inclinations on both sides of the ridgeline 20*a* is set to from 1 degree to less than 90 degrees (see FIG. 7). The fold angle α is preferably from 3 degrees to 15 degrees, and more preferably from 3 degrees to 10 degrees. Additionally, a bend radius R1 at the position of the ridgeline 20*a* is set to, for example, from 0.1 mm to 30 mm (see FIG. 7). The bend radius is a radius on a side of less than 180 degrees.

The ridgeline 20*a* does not necessarily have to linearly extend, and may be formed so as to slightly curve. In addition, a structural analysis such as CAD analysis may be performed to estimate the moving direction S of the material, and an extending direction of the ridgeline 20*a* may be set so as to be orthogonal to the estimated moving direction S of the material.

Furthermore, when providing two or more ridgelines 20*a*, the two or more ridgelines 20*a* are formed so as to be aligned in the moving direction S of the material. Directions of protruding sides of the two or more ridgelines 20*a* are preferably set in the same direction in a vertical direction (see FIG. 8).

Additionally, in the present embodiment, preferably, the set position of each ridgeline 20*a* is set at a position such that the top sheet portion 2 is located on the vertical wall portion 3 side rather than positions of all the ridgelines 20*a* in the state where the forming of the vertical wall portion 3 and the flange portion 4 by the relative movement of the upper die 40 is complete.

The following description will be given assuming that the set position of each ridgeline 20*a* is set at a position such that the position of the top sheet portion 2 is located on the vertical wall portion 3 side rather than the positions of all the ridgelines 20*a* in the state where the forming of the vertical wall portion 3 and the flange portion 4 by the relative movement of the upper die 40 is complete (see FIG. 9).

In addition, a sandwiching surface of the pad 30 has a surface shape following the surface of the lower die 20 facing via the metal sheet. In other words, the pad 30 is provided with a ridgeline 30*a* as a second ridgeline extending in the same direction as each facing ridgeline 20*a* at a position facing the each ridgeline 20*a* provided on the surface of the lower die on the surface of the pad 30. The surface of the pad 30 is shaped so as to follow the facing surface of the lower die 20 on both sides of the each ridgeline 30*a*. Specifically, on the sandwiching surface of the pad 30, the ridgeline 30*a* of the pad 30 side is formed at a position vertically facing the ridgeline 20*a* formed on the surface of the lower die 20, and the sandwiching surface of the pad 30 has different surface inclinations on both sides of the ridgeline 30*a*. A difference (fold angle β) between the surface inclinations on both sides of the ridgeline 30*a* on the sandwiching surface of the pad 30 and a bend radius R2 are set to be equal to the difference a between the inclinations on the lower die 20 and the bend radius R1 (see FIG. 7). Note that the bend radius R2 does not have to be equal to the bend radius R1, but is preferably equal to or less than the bend radius R1.

A pressure of the pad pressure (sandwiching pressure by the lower die 20 and the pad 30) is set to a pressure at which no wrinkles occur on the top sheet portion 2 of the curved portion during bending (for example, a pressure at which a gap between the pad 30 and the punch does not become equal to or larger than a thickness of the blank material until a forming bottom dead center). Then, the blank material is pressed in a state where the material can move in the curved portion during the above bending.

As a pre-step of the above main forming step, a step of providing a partial shape to the top sheet surface or the like may be provided. Additionally, as a post-step of the above main forming step, restriking to a final product or trimming of the outer periphery may be performed. In other words, provision of a shape such as a seating face for spot welding, a trimming and piercing step, and a restriking step can be added as pre- and post-steps. Furthermore, it is desirable to avoid as much as possible provision of a shape other than a fold line in the region of the top sheet portion 2 where material movement occurs because sliding marks may occur. However, there is no problem in providing a shape to a region where no material movement occurs.

In the manufacturing method of the present embodiment, the lower die 20 and the pad 30 press at least the region (sandwiching region P) including the top sheet portion 2 of the curved portion that is a region where material movement occurs during bending. At this time, the ridgelines 20*a* and 30*a* provided on the lower die 20 and the pad 30 give a bend that is an out-of-plane deformation to the sandwiched metal sheet portion at the positions of the ridgelines 20*a* and 30*a*. By doing this, when, during the bending, the metal sheet portion sandwiched by the lower die 20 and the pad 30 moves to the vertical wall portion 3 side, out-of-plane bending and unbending deformations are continuously applied to the sandwiched metal sheet portion at the time of passage through bend portion positions that are the positions of the ridgelines 20*a* and 30*a* described above.

In other words, while the out-of-plane deformation position is moved by the ridgelines 20*a* and 30*a*, the metal sheet portion sandwiched by the lower die 20 and the pad 30 moves to the vertical wall portion 3 side, so that the ridgelines 20*a* and 30*a* serve to suppress the material movement in the sandwiching region P during the bending. In short, material movement conditions can be controlled by setting the ridgelines 20*a* and 30*a*.

A more specific description will be given.

Figure 2:
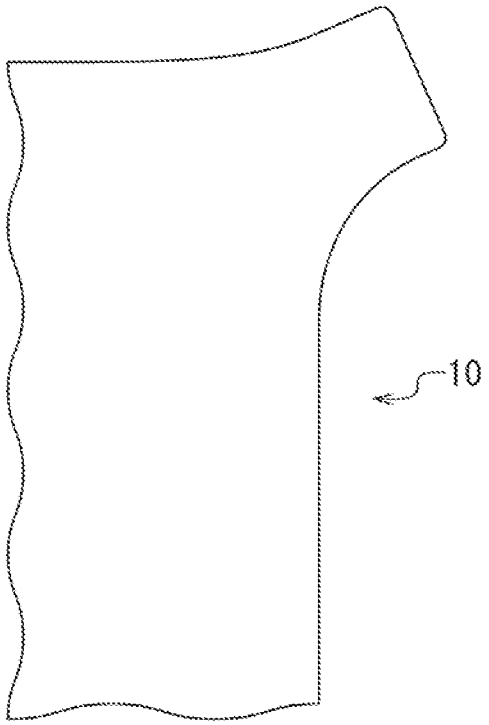
FIG. 2 is a plan view illustrating an example of a metal sheet.
Figure 3:
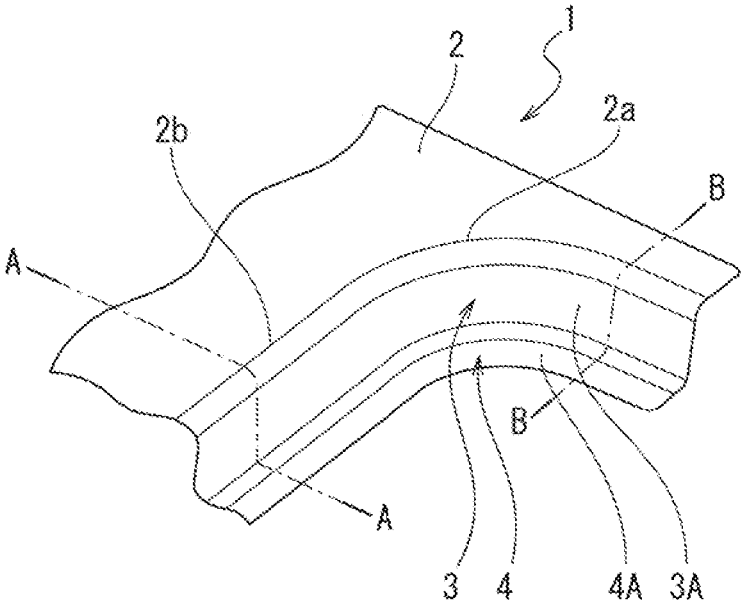
FIG. 3 is a diagram illustrating the shape of a component according to an embodiment based on the present invention.

The following example will exemplify a case in which a metal sheet 10 as illustrated in FIG. 2 is press formed to manufacture the component 1 having the component shape as illustrated in FIG. 3.

Figure 4:
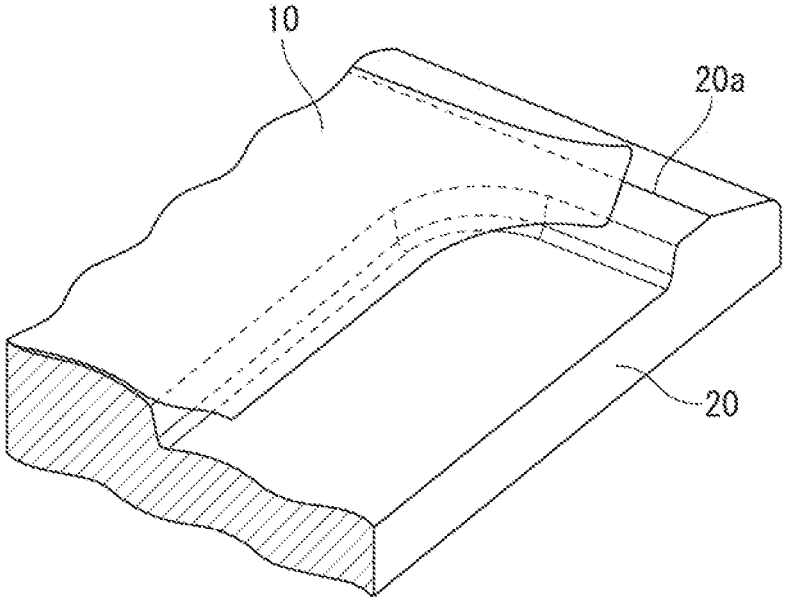
FIG. 4 is a diagram illustrating a state where the metal sheet is arranged on a lower die according to a first embodiment based on the present invention.

As illustrated in FIG. 4, the metal sheet 10 is placed on the top sheet surface of the lower die 20. As illustrated in FIG.

5, the sandwiching region P including the metal sheet 10 portion corresponding to the top sheet portion 2 of the curved portion (the curved outer peripheral edge portion 2*a* curved in such a manner as to be recessed inward) is pressed against the lower die 20 by the pad 30 and sandwiched by the lower die 20 and the pad 30.

In this case, when bending the vertical wall portion 3 and the flange portion 4, at least the curved portion and a vicinity thereof are set to be at a pad pressure at which the sandwiched metal sheet 10 portion can move to the vertical wall portion 3 side.

In this state, the upper die 40 that is a bending die is moved in a pressing direction along a side surface portion of the lower die 20, whereby the metal sheet 10 is bent so as to follow the side surface portion and a bottom surface portion of the lower die 20 to form the vertical wall portion 3 and the flange portion 4, resulting in formation of the desired press-formed component.

Figure 6A:
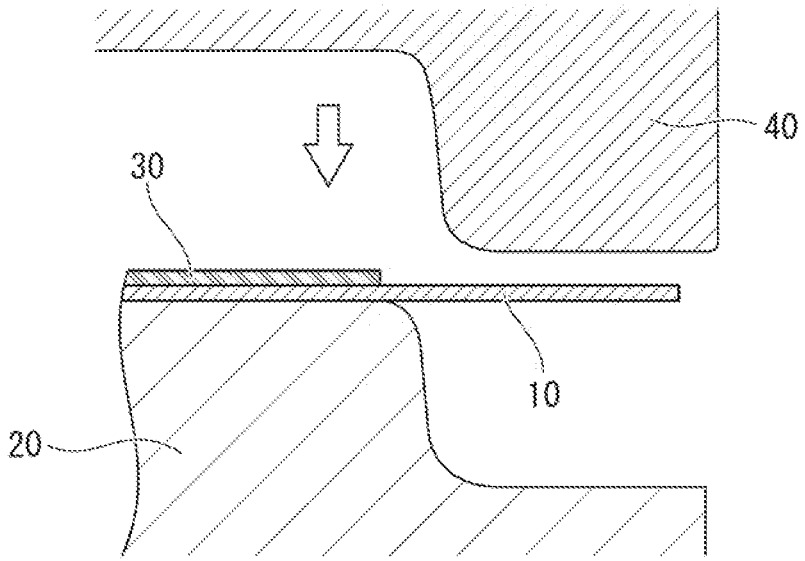
FIG. 6 is a diagram illustrating bending at a position A-A of FIG. 3 in the first embodiment based on the present invention.
Figure 6B:
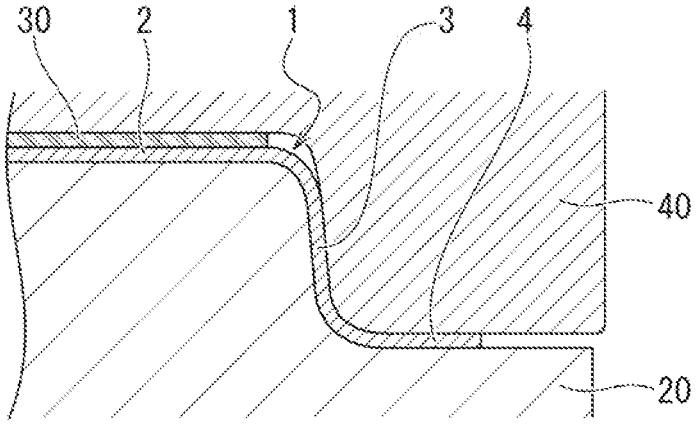

In this case, as for the vertical wall portion 3 and the flange portion 4 located on a lower side portion of the sheet surface of FIG. 5 and continuous with the linearly extending outer edge portion 2*b* other than the curved outer peripheral edge portion 2*a* of the top sheet portion 2, the metal sheet 10 is bent by movement of the upper die 40 in the pressing direction to form the vertical wall portion 3 and the flange portion 4, as illustrated in FIG. 6.

Additionally, during the bending, the material of the metal sheet 10 portion sandwiched by the pad 30 and the lower die 20 moves to the vertical wall portion 3A side in the region of the vertical wall portion 3A and the flange portion 4A continuous with the curved outer peripheral edge portion 2*a*, as illustrated in FIG. 7.

In this case, in the present embodiment, the lower die 20 is provided with the ridgeline 20*a*. Thereby, when the material of the metal sheet 10 portion sandwiched by the pad 30 and the lower die 20 passes through the position of the ridgeline 20*a*, the material is bent while undergoing out-of-plane bending and unbending at the position of the ridgeline 20*a*, with the bend position continuously moving along with the movement of the material.

Thus, in the present embodiment, when the material moves, bending and unbending resistances can be continuously generated in the material in addition to a frictional resistance between the die and the material, which can stabilize the amount of material movement on the top sheet surface during bending. Here, the bending and unbending resistances are larger than the frictional resistance, and are less susceptible to fluctuations in mass production. Therefore, in the present embodiment, fluctuations in material movement in mass production can be reduced, so that sporadic stretch flange cracking can be more effectively suppressed.

Here, by providing the ridgeline 20*a* described above, the lower die 20 is formed with a surface having a mountain-shaped cross section with the ridgeline 20*a* at the top. When a bead shape having a semicircular or trapezoidal cross section is formed instead of forming the ridgeline 20*a*, the number of times of bending and unbending increases as compared to when the ridgeline 20*a* is formed, which easily causes surface defects. Then, the surface defects left in a product may be problematic. Furthermore, use of a bead shape requires large pad force as compared to the ridgeline 20*a*. Due to that, when a bead shape is used, it is insufficient to secure the pad force due to the structure of the die depending on the shape of the pad (particularly when the pad is small in size). In that case, the material is insufficiently pressed by the pad during forming, and the amount of material movement on the top sheet surface during the forming may be unstable, so that control may be difficult.

The bending and unbending resistances greatly vary with the angle (fold angle $\alpha$) at the position of the ridgeline 20*a* and the bend radius R1 of the ridgeline 20*a*. If the fold angle $\alpha$ is 1 degree or less, the bending and unbending resistances may be small. The fold angle $\alpha$ can be set up to an angle of less than 90 degrees by adjustment of the pad pressure. However, depending on the pad pressure, if the fold angle $\alpha$ is 15 degrees or more, stretch flange cracking may occur due to increased bending and unbending resistances at the time of passage through the positions of the ridgelines 20*a* and 30*a*. Therefore, the fold angle $\alpha$ is preferably from 1 to 15 degrees, and more preferably from 1 to 10 degrees. In addition, considering stability in mass production, the fold angle $\alpha$ is preferably 3 degrees or more.

Additionally, if the bend radius R1 of the bent ridgeline 20*a* is 0.1 mm or less, die galling is highly likely to occur at the time of passage through the ridgeline positions, and if it is 30 mm or more, the bending and unbending resistances are likely to be insufficient. Therefore, the bend radius R1 is preferably from 0.1 mm to 30 mm. In addition, considering the combination with the bend angle, the bend radius R1 is more preferably from 1 mm to 20 mm.

Note that there are appropriate conditions for setting the bent ridgeline 20*a* (fold angle $\alpha$ and bend radius R1) in accordance with the product shape, the surface state of a material such as plating, the shape of the metal sheet 10, and the like. Appropriate conditions can be obtained from computer simulation by FEM analysis. In addition, preferably, the ridgelines 20*a* and 30*a* are set on the entire length of the region where material movement occurs.

Figure 8:
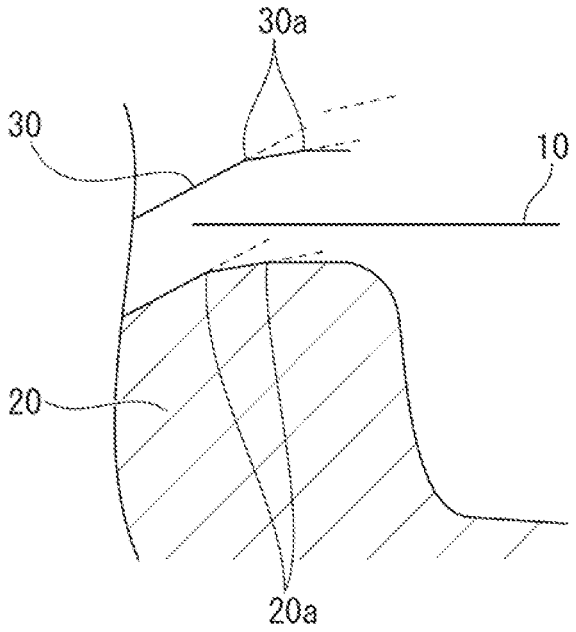
FIG. 8 is a diagram illustrating an example in which two ridgelines according to the first embodiment based on the present invention are provided.

Furthermore, as illustrated in FIG. 8, increasing the number of the ridgelines 20*a* can reduce the fold angle $\alpha$ of each ridgeline 20*a*.

Additionally, during forming, wrinkles are likely to occur at a position corresponding to the top sheet portion 2 of the curved portion. If the pad pressure is too small to suppress the occurrence of wrinkles, a gap between the pad 30 and the upper die 40 becomes large, which destabilizes the occurrence of the bending and unbending resistances by the ridgelines 20*a* and 30*a*. It is therefore preferable to set the pressure and shape of the pad 30 such that the pad 30 can press at a pressure at which no wrinkles occur on the surface of the top sheet portion 2 of the curved portion during forming.

If the positions of the ridgelines 20*a* and 30*a* are set inside a final product in which bending has been completed by moving the upper die 40 to the bottom dead center, sliding marks may occur in the region where the material has passed through the ridgelines 20*a* and 30*a* during the forming, which can affect appearance quality. Furthermore, since fold lines formed by the ridgelines 20*a* and 30*a* are left in the product, the shape of the product can be restricted. Thus, the positions of the ridgelines 20*a* and 30*a* are preferably set such that the position corresponding to the top sheet portion 2 in the metal sheet 10 is at a position that has moved to the vertical wall portion 3 side rather than the positions of the ridgelines 20*a* and 30*a* when the forming of the vertical wall portion 3 and the flange portion 4 by the relative movement of the upper die 40 is complete.

Figure 9:
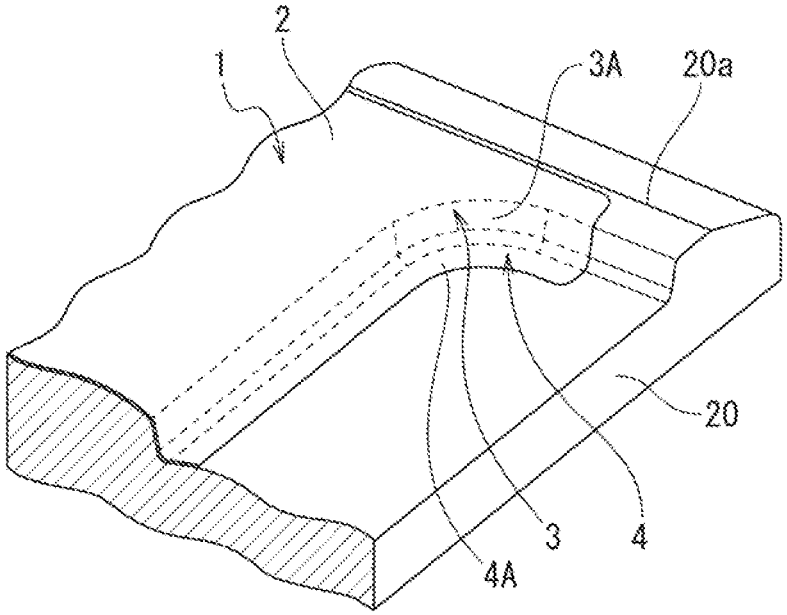
FIG. 9 is a diagram illustrating the lower die and a formed component at the time of completion of the bending according to the first embodiment based on the present invention.

FIG. 9 illustrates a relationship between the lower die 20 and the component 1 at the time of completion of the bending.

As described above, the present embodiment enables L- or T-shaped components that could cause stretch flange cracking to be manufactured stably at low cost even in mass production.

Figure 10:
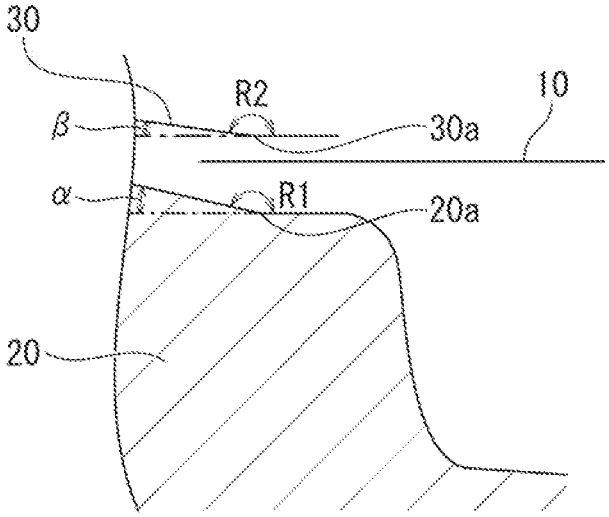
FIG. 10 is a diagram illustrating another example of an inclination of the ridgeline according to the first embodiment based on the present invention.

Note that although FIG. 7 exemplifies the case where the ridgeline 20*a* is set so as to protrude upward, the ridgeline 20*a* may be set so as to protrude downward, as illustrated in FIG. 10.

Second Embodiment

Next, a second embodiment of the present invention will be described with reference to the drawings.

In the first embodiment, in the state where the bending is complete, the one or more ridgelines provided in the sandwiching region P are set at the position such that the position of the top sheet portion 2 is located on the vertical wall portion 3 side rather than the positions of all the ridgelines. On the other hand, the second embodiment is different from the first embodiment in that the position of each ridgeline is set such that at least a part of at least one ridgeline of all the ridgelines provided in the sandwiching region P overlaps with the top sheet portion 2 in the state where the bending is complete.

Other structures of the second embodiment are the same as those of the first embodiment described above.

Additionally, the same components as those of the first embodiment are denoted by the same reference signs for the description.

A method for manufacturing the press-formed component 1 of the present embodiment is a method for manufacturing the press-formed component 1, which manufactures the press-formed component 1 by press forming a metal sheet (referred to also as blank material) into a previously set press formed shape. The set press formed shape is a component shape (see FIG. 1) including a top sheet portion 2 including a curved outer peripheral edge portion 2*a* curved in such a manner that a part of an outer peripheral edge is recessed inward, a vertical wall portion 3A continuous with the curved outer peripheral edge portion 2*a* of the top sheet portion 2, and a flange portion 4A continuous with the vertical wall portion 3A and bent toward the top sheet portion 2.

The method for manufacturing the press-formed component 1 of the present embodiment is a technology that is suitable when the metal sheet is a high tensile strength steel sheet having a tensile strength of 590 MPa or more, preferably 780 MPa or more.

The press-formed component 1 that is the subject of the present embodiment is the same as that of the first embodiment, such as, for example, a T-shaped component or an L-shaped component, as illustrated in FIG. 1.

The method for manufacturing the press-formed component 1 of the present embodiment also manufactures the press-formed component 1 by bending-based press forming. A press forming die for use in the press forming of the present embodiment includes an upper die 40 (bending die), a lower die 20 (punch), and a pad 30 (see FIGS. 13 and 14).

Then, in the method for manufacturing the press-formed component 1 of the present embodiment, when forming the vertical wall portion 3A continuous with the curved outer peripheral edge portion 2*a* of the top sheet portion 2 and the flange portion 4A continuous with the vertical wall portion 3A and bent toward the top sheet portion 2, a sandwiching region P that is a region including at least a part of a region corresponding to the top sheet portion 2 in the metal sheet is sandwiched by the lower die 20 and the pad 30. Then, by moving the upper die 40 relatively with respect to the lower die 20 in a pressing direction, the vertical wall portion 3 and the flange portion 4 are bent into a desired component shape while moving the material of the sandwiching region P sandwiched by the lower die 20 and the pad 30 to the vertical wall portion 3 side.

Figure 12:
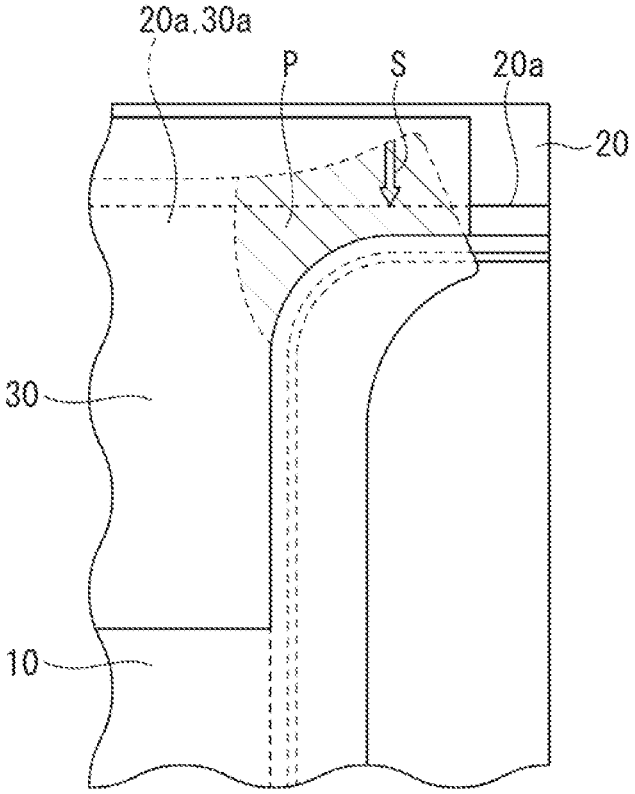
FIG. 12 is a plan view illustrating an example of a relationship between the metal sheet according to the second embodiment based on the present invention and a pad.
Figure 14A:
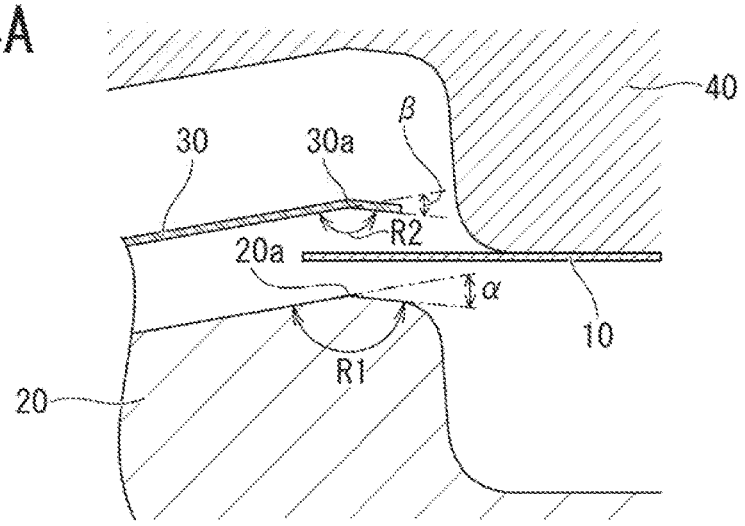
FIG. 14 is a diagram illustrating bending at the position B-B of FIG. 3 in the second embodiment based on the present invention.
Figure 14B:
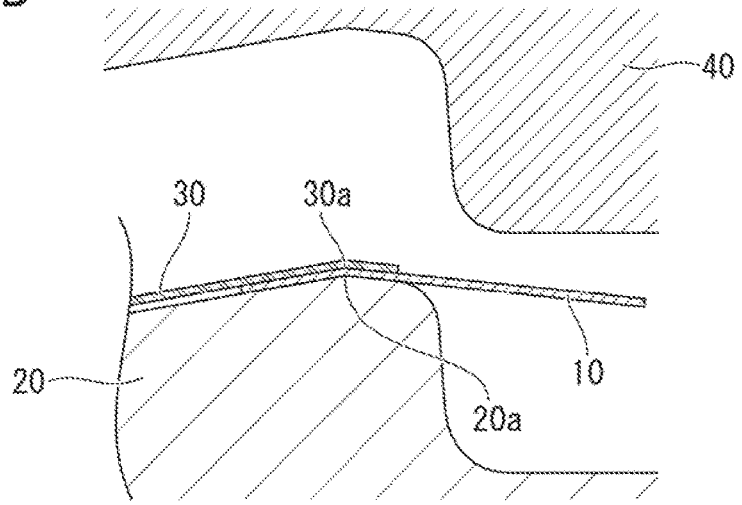
Figure 14C:
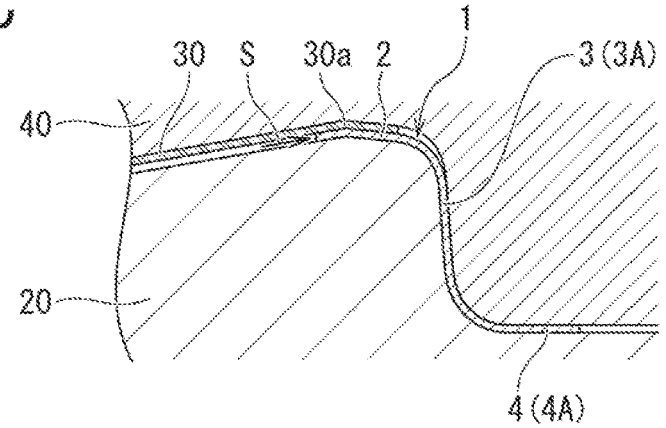

A surface of the lower die 20 (a surface portion facing the pad 30) that sandwiches the above sandwiching region P is provided with one or more ridgelines 20*a* extending in a direction intersecting with a moving direction S of the material (see FIGS. 12 and 14). As a result, the surface of the lower die 20 has different surface inclinations on both sides of each ridgeline 20*a*.

Movement of the material mainly occurs on a side where a distance from the curved outer peripheral edge portion 2*a* to an end portion of the metal sheet 10 is small. Additionally, in the case of a component shape as in FIG. 3, even at a vertical wall portion position continuous with a linear outer edge portion continuous with a right side (the right side on the drawing sheet surface) of the curved outer peripheral edge portion 2*a*, the movement of the material to the vertical wall portion side occurs during bending.

Due to this, the ridgeline 20*a* is arranged on the side where the distance from the curved outer peripheral edge portion 2*a* to the end portion of the metal sheet 10 is small.

A difference (hereinafter referred to also as fold angle $\alpha$) between the surface inclinations on both sides of the ridgeline 20*a* is set to from 1 degree to less than 90 degrees (see FIG. 14). The fold angle $\alpha$ is preferably from 3 degrees to 15 degrees, and more preferably from 3 degrees to 10 degrees. Additionally, a bend radius R1 at the position of the ridgeline 20*a* is set to, for example, from 0.1 mm to 30 mm (see FIG. 14). The bend radius is a radius on a side of less than 180 degrees.

The ridgeline 20*a* does not necessarily have to linearly extend, and may be formed so as to slightly curve. In addition, a structural analysis such as CAD analysis may be performed to estimate the moving direction S of the material, and an extending direction of the ridgeline 20*a* may be set so as to be orthogonal to the estimated moving direction S of the material.

Furthermore, when providing two or more ridgelines 20*a*, the two or more ridgelines 20*a* are formed so as to be aligned in the moving direction S of the material. Directions of protruding sides of the two or more ridgelines 20*a* are preferably set in the same direction in a vertical direction (see FIG. 15).

Additionally, as for the set position of each ridgeline 20*a* in the present embodiment, the position of each ridgeline 20*a* is set such that, in the state where the forming of the vertical wall portion 3 and the flange portion 4 by the relative movement of the upper die 40 is complete, at least a part of at least one ridgeline 20*a* of all the ridgelines 20*a* overlaps with the top sheet portion 2. When only one ridgeline 20*a* is provided, at least a part of the ridgeline 20*a* is set so as to overlap with the top sheet portion 2 in the state where the bending is complete (see FIG. 16).

In addition, a sandwiching surface of the pad 30 has a surface shape following the surface of the lower die 20 facing via the metal sheet. In other words, the pad 30 is provided with a ridgeline 30*a* as a second ridgeline extending in the same direction as each facing ridgeline 20*a* at a position facing the each ridgeline 20*a* provided on the surface of the lower die on the surface of the pad 30. The surface of the pad 30 is shaped so as to follow the facing surface of the lower die 20 on both sides of the each ridgeline 30*a*. Specifically, on the sandwiching surface of the pad 30, the ridgeline 30*a* of the pad 30 side is formed at a position vertically facing the ridgeline 20*a* formed on the surface of the lower die 20, and the sandwiching surface of the pad 30 has different surface inclinations on both sides of the ridgeline 30*a*. A difference (fold angle β) between the surface inclinations on both sides of the ridgeline 30*a* on the sandwiching surface of the pad 30 and a bend radius R2 are set to be equal to the difference a between the inclinations on the lower die 20 and the bend radius R1 (see FIG. 14). Note that the bend radius R2 does not have to be equal to the bend radius R1, but is preferably equal to or less than the bend radius R1.

A pressure of the pad pressure (sandwiching pressure by the lower die 20 and the pad 30) is set to a pressure at which no wrinkles occur on the top sheet portion 2 of the curved portion during bending (for example, a pressure at which a gap between the pad 30 and the punch does not become equal to or larger than a thickness of the blank material until a forming bottom dead center). Then, the blank material is pressed in a state where the material can move in the curved portion during the above bending.

As a pre-step of the above main forming step, a step of providing a partial shape to the top sheet surface or the like may be provided. Additionally, as a post-step of the above main forming step, restriking to a final product or trimming of the outer periphery may be performed. In other words, provision of a shape such as a seating face for spot welding, a trimming and piercing step, and a restriking step can be added as pre- and post-steps. Furthermore, it is desirable to avoid as much as possible provision of a shape other than a fold line in the region of the top sheet portion 2 where material movement occurs because sliding marks may occur. However, there is no problem in providing a shape to a region where no material movement occurs.

In the manufacturing method of the present embodiment, the lower die 20 and the pad 30 press at least the region (sandwiching region P) including the top sheet portion 2 of the curved portion that is a region where material movement occurs during bending. At this time, the ridgelines 20*a* and 30*a* provided on the lower die 20 and the pad 30 give a bend that is an out-of-plane deformation to the sandwiched metal sheet portion at the positions of the ridgelines 20*a* and 30*a*. By doing this, when, during the bending, the metal sheet portion sandwiched by the lower die 20 and the pad 30 moves to the vertical wall portion 3 side, out-of-plane bending and unbending deformations are continuously applied to the sandwiched metal sheet portion at the time of passage through bend portion positions that are the positions of the ridgelines 20*a* and 30*a* described above.

In other words, while the out-of-plane deformation position is moved by the ridgelines 20*a* and 30*a*, the metal sheet portion sandwiched by the lower die 20 and the pad 30 moves to the vertical wall portion 3 side, so that the ridgelines 20*a* and 30*a* serve to suppress the material movement in the sandwiching region P during the bending. In short, material movement conditions can be controlled by setting the ridgelines 20*a* and 30*a*.

A more specific description will be given.

The following example will exemplify a case in which a metal sheet 10 as illustrated in FIG. 2 is press formed to manufacture the component 1 having the component shape as illustrated in FIG. 3.

Figure 11:
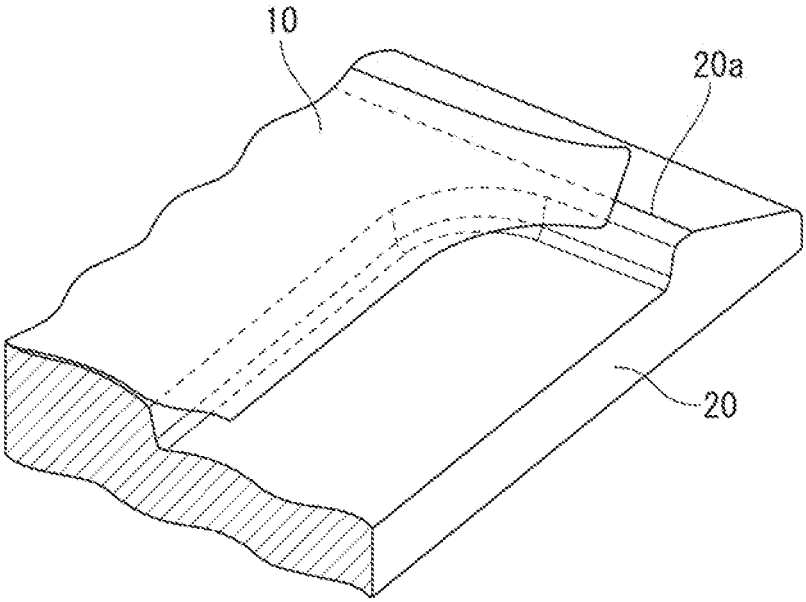
FIG. 11 is a diagram illustrating a state where the metal sheet is arranged on a lower die according to a second embodiment based on the present invention.

As illustrated in FIG. 11, the metal sheet 10 is placed on the top sheet surface of the lower die 20. As illustrated in FIG. 12, the sandwiching region P including the metal sheet 10 portion corresponding to the top sheet portion 2 of the curved portion (the curved outer peripheral edge portion 2*a* curved in such a manner as to be recessed inward) is pressed against the lower die 20 by the pad 30 and sandwiched by the lower die 20 and the pad 30.

In this case, when bending the vertical wall portion 3 and the flange portion 4, at least the curved portion and a vicinity thereof are set to be at a pad pressure at which the sandwiched metal sheet 10 portion can move to the vertical wall portion 3 side.

In this state, the upper die 40 that is a bending die is moved in a pressing direction along a side surface portion of the lower die 20, whereby the metal sheet 10 is bent so as to follow the side surface portion and a bottom surface portion of the lower die 20 to form the vertical wall portion 3 and the flange portion 4, resulting in formation of the desired press-formed component.

Figure 13A:
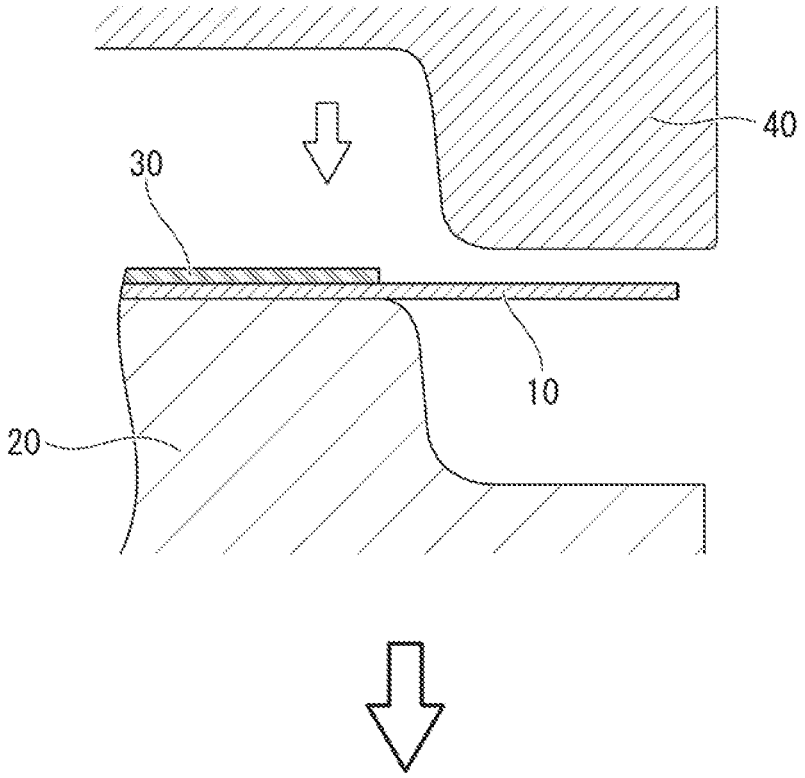
FIG. 13 is a diagram illustrating bending at the position A-A of FIG. 3 in the second embodiment based on the present invention.
Figure 13B:
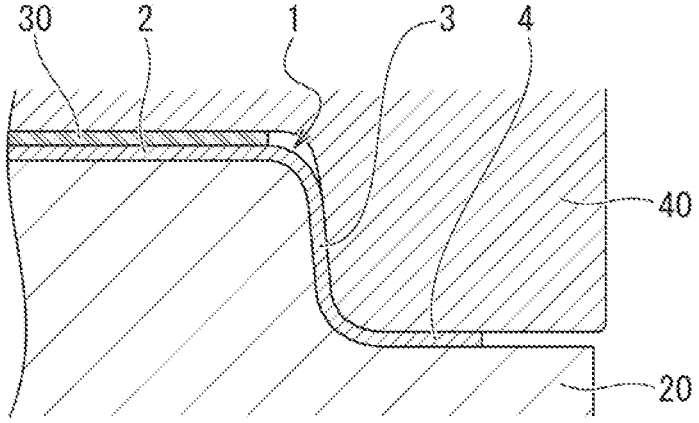

In this case, as for the vertical wall portion 3 and the flange portion 4 located on a lower side portion of the sheet surface of FIG. 12 and continuous with the linearly extending outer edge portion 2*b* other than the curved outer peripheral edge portion 2*a* of the top sheet portion 2, the metal sheet 10 is bent by movement of the upper die 40 in the pressing direction to form the vertical wall portion 3 and the flange portion 4, as illustrated in FIG. 13.

Additionally, during the bending, the material of the metal sheet 10 portion sandwiched by the pad 30 and the lower die 20 moves to the vertical wall portion 3A side in the region of the vertical wall portion 3A and the flange portion 4A continuous with the curved outer peripheral edge portion 2*a*, as illustrated in FIG. 14.

In this case, in the present embodiment, the lower die 20 is provided with the ridgeline 20*a*. Thereby, when the material of the metal sheet 10 portion sandwiched by the pad 30 and the lower die 20 passes through the position of the ridgeline 20*a*, the material is bent while undergoing out-of-plane bending and unbending at the position of the ridgeline 20*a*, with the bend position continuously moving along with the movement of the material.

Thus, in the present embodiment, when the material moves, bending and unbending resistances can be continuously generated in the material in addition to a frictional resistance between the die and the material, which can stabilize the amount of material movement on the top sheet surface during bending. Here, the bending and unbending resistances are larger than the frictional resistance, and are less susceptible to fluctuations in mass production. Therefore, in the present embodiment, fluctuations in material movement in mass production can be reduced, so that sporadic stretch flange cracking can be more effectively suppressed.

Here, by providing the ridgeline 20*a* described above, the lower die 20 is formed with a surface having a mountain-shaped cross section with the ridgeline 20*a* at the top. When a bead shape having a semicircular or trapezoidal cross section is formed instead of forming the ridgeline 20*a*, the number of times of bending and unbending increases as compared to when the ridgeline 20*a* is formed, which easily causes surface defects. Then, the surface defects left in a product may be problematic. Furthermore, use of a bead shape requires large pad force as compared to the ridgeline 20*a*. Due to that, when a bead shape is used, it is insufficient to secure the pad force due to the structure of the die depending on the shape of the pad (particularly when the pad is small in size). In that case, the material is insufficiently pressed by the pad during forming, and the amount of material movement on the top sheet surface during the forming may be unstable, so that control may be difficult.

The bending and unbending resistances greatly vary with the angle (fold angle α) at the position of the ridgeline 20*a* and the bend radius R1 of the ridgeline 20*a*. If the fold angle α is 1 degree or less, the bending and unbending resistances may be small. The fold angle α can be set up to an angle of less than 90 degrees by adjustment of the pad pressure. However, depending on the pad pressure, if the fold angle α is 15 degrees or more, stretch flange cracking may occur due to increased bending and unbending resistances at the time of passage through the positions of the ridgelines 20*a* and 30*a*. Therefore, the fold angle α is preferably from 1 to 15 degrees, and more preferably from 1 to 10 degrees. In addition, considering stability in mass production, the fold angle α is preferably 3 degrees or more.

Additionally, if the bend radius R1 of the bent ridgeline 20*a* is 0.1 mm or less, die galling is highly likely to occur at the time of passage through the ridgeline positions, and if it is 30 mm or more, the bending and unbending resistances are likely to be insufficient. Therefore, the bend radius R1 is preferably from 0.1 mm to 30 mm. In addition, considering the combination with the bend angle, the bend radius R1 is more preferably from 1 mm to 20 mm.

Note that there are appropriate conditions for setting the bent ridgeline 20*a* (fold angle α and bend radius R1) in accordance with the product shape, the surface state of a material such as plating, the shape of the metal sheet 10, and the like. Appropriate conditions can be obtained from computer simulation by FEM analysis. In addition, preferably, the ridgelines 20*a* and 30*a* are set on the entire length of the region where material movement occurs.

Figure 15:
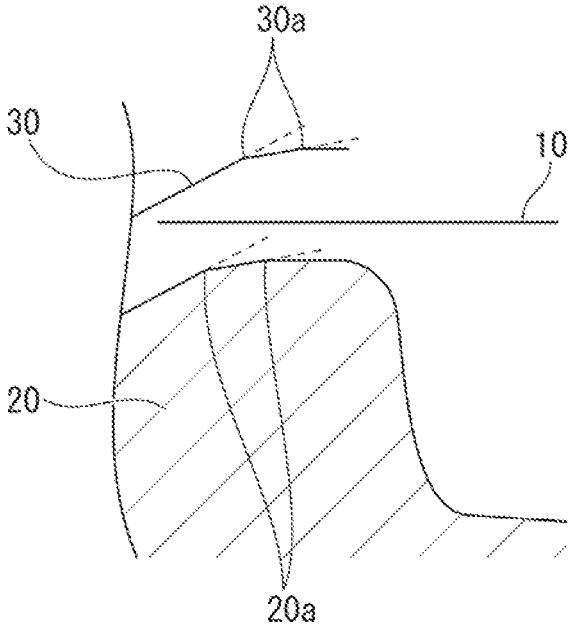
FIG. 15 is a diagram illustrating an example in which two ridgelines according to the second embodiment based on the present invention are provided.

Furthermore, as illustrated in FIG. 15, increasing the number of the ridgelines 20*a* can reduce the fold angle α of each ridgeline 20*a*.

Additionally, during forming, wrinkles are likely to occur at a position corresponding to the top sheet portion 2 of the curved portion. If the pad pressure is too small to suppress the occurrence of wrinkles, a gap between the pad 30 and the upper die 40 becomes large, which destabilizes the occurrence of the bending and unbending resistances by the ridgelines 20*a* and 30*a*. Thus, it is preferable to set the pressure and shape of the pad 30 such that the pad 30 can press at a pressure at which no wrinkles occur on the surface of the top sheet portion 2 of the curved portion during forming.

If the positions of the ridgelines 20*a* and 30*a* are set outside the final product in which bending has been completed by moving the upper die 40 to the bottom dead center, the amount of trimming in the post-step increases, which significantly reduces material yield. Therefore, the positions of the ridgelines 20*a* and 30*a* are set in the final product under a condition that no sliding marks are left. Furthermore, since providing the bending and unbending at the fold line positions stabilizes the amount of material movement, designing the shape of the blank such that the shape after forming becomes the outer periphery of a final product shape can lead to a trimming step reduction, thereby enabling further cost reduction.

Figure 16:
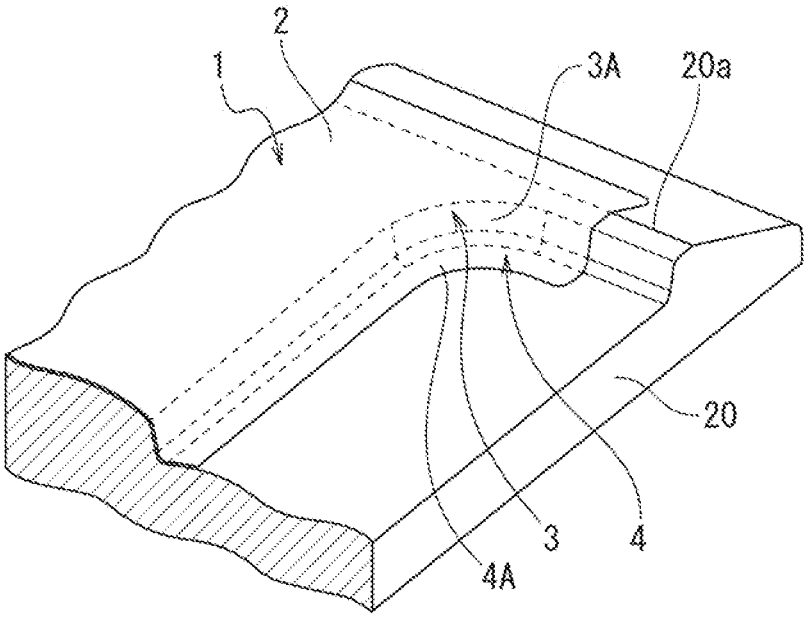
FIG. 16 is a diagram illustrating the lower die and a formed component at the time of completion of the bending according to the second embodiment based on the present invention.

FIG. 16 illustrates a relationship between the lower die 20 and the component 1 at the time of completion of the bending.

As described above, the present embodiment enables L- or T-shaped components that could cause stretch flange cracking to be manufactured stably at low cost even in mass production.

Figure 17:
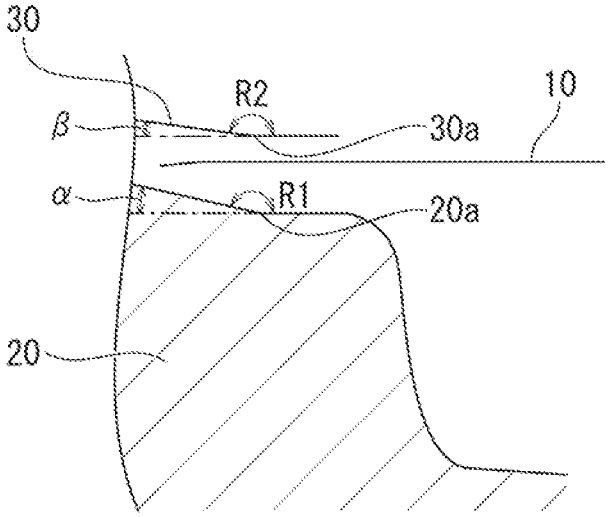
FIG. 17 is a diagram illustrating other examples of inclinations of the ridgelines according to the second embodiment based on the present invention.

Note that although FIG. 14 exemplifies the case where the ridgeline 20*a* is set so as to protrude upward, the ridgeline 20*a* may be set so as to protrude downward, as illustrated in FIG. 17.

EXAMPLE

Figure 1B:
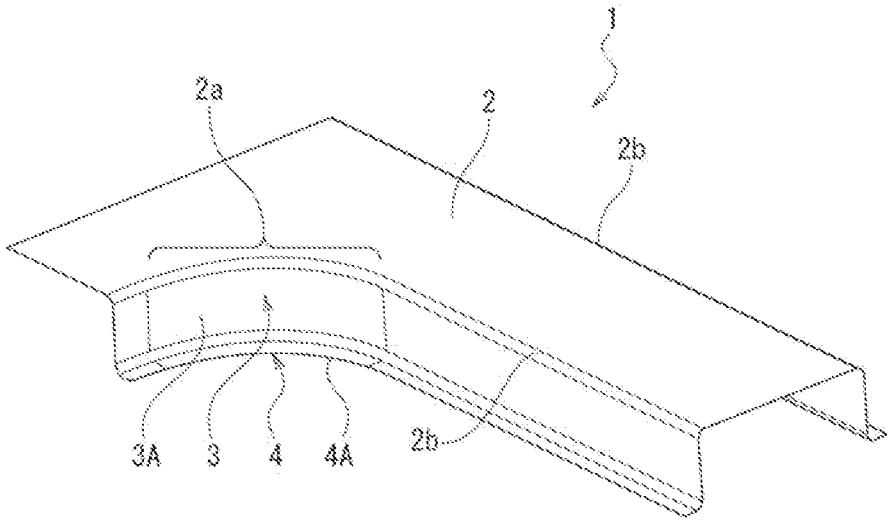

An FEM analysis was performed under a condition that the metal sheet 10 was press-formed into the L-shaped press-formed component 1 illustrated in FIG. 1B while being sandwiched by the lower die 20 and the pad 30. The material of the metal sheet 10 used had a tensile strength of 980 MPa class and a sheet thickness of 1.2 mm. Additionally, the pad pressure was 10 tons.

When the lower die 20 had a planar shape without the ridgelines 20*a* and 30*a* (not provided with the ridgelines 20*a* and 30*a*), movement of the material was large in the curved portion, and there was a high risk of stretch flange cracking at a lower end of the blank portion of the curved portion.

On the other hand, an analysis was performed under a condition that the lower die 20 and the pad 30 were provided with each one ridgeline 20*a*, 30*a* at the fold angle α, β of 10 degrees with the bend radius R1, R2 of 10 mm. The analysis confirmed that the amount of material movement was stable, and forming was able to be performed without any stretch flange cracking.

Here, the present application claims priority to Japanese Patent Application Nos. 2018-099807 (filed on May 24, 2018) and 2018-099808 (filed on May 24, 2018), the entire contents of which are incorporated by reference as apart of the present disclosure. Herein, while the present invention has been described with reference to the limited number of embodiments, the scope of the present invention is not limited thereto. It is apparent that modifications and adaptations to the respective embodiments based on the above disclosure may occur to those skilled in the art.

REFERENCE SIGNS LIST

1: Component
2: Top sheet portion
2*a*: Curved outer peripheral edge portion
3: Vertical wall portion
3A: Vertical wall portion continuous with curved outer peripheral edge portion
4, 4A: Flange portion
10: Metal sheet
20: Lower die
20*a*: Ridgeline
30: Pad
30*a*: Ridgeline (second ridgeline)
40: Upper die
P: Sandwiching region
R1: Bend radius
α: Fold angle

The invention claimed is:

1. A method for manufacturing a press-formed component, which manufactures the press-formed component by press forming a metal sheet into a component shape including a top sheet portion including a curved outer peripheral edge portion curved in such a manner that a part of an outer peripheral edge is recessed inward, a vertical wall portion continuous with the curved outer peripheral edge portion of the top sheet portion, and a flange portion continuous with the vertical wall portion and bent toward the top sheet portion side, the method comprising:

in a state where a lower die and a pad sandwich a sandwiching region that is a region including at least a part of a region corresponding to the top sheet portion in the metal sheet, moving an upper die relatively with respect to the lower die in a pressing direction to perform bending of the vertical wall portion and the flange portion while moving at least a part of a material of the sandwiching region sandwiched by the lower die and the pad to the vertical wall portion side, wherein during the bending, as the material is moved, out-of-plane bending and unbending deformations separate from the curved outer peripheral edge portion are continuously applied to the metal sheet region sandwiched by the lower die and the pad at a position of a bend portion extending in a direction intersecting with a moving direction of the material to control the movement of the material, the out-of-plane bending and unbending deformations having a bending angle in the range of from 3 degrees to 15 degrees, the bending angle being an offset angle between two flat portions of the steel sheet on either side of the out-of-plane bending and unbending deformations.

2. The method for manufacturing a press-formed component according to claim 1, wherein a surface of the lower die that sandwiches the sandwiching region is provided with, as the bend portion, one or more ridgelines extending in the direction intersecting with the moving direction of the material, the surface of the lower die having different surface inclinations on both sides of each of the ridgelines, and the each ridgeline being set at a position such that, in a state where the bending is complete, a position of the top sheet portion is located on a vertical wall portion side rather than all the ridgelines.

3. The method for manufacturing a press-formed component according to claim 1, wherein a surface of the lower die that sandwiches the sandwiching region is provided with, as the bend portion, one or more ridgelines extending in the direction intersecting with the moving direction of the material, the surface of the lower die having different surface inclinations on both sides of each of the ridgelines, and a position of the each ridgeline being set such that, in a state where the bending is complete, at least a part of at least one ridgeline of all the ridgelines overlaps with the top sheet portion.

4. The method for manufacturing a press-formed component according to claim 2, wherein a difference between the surface inclinations on both sides of the each ridgeline is from 1 degree to less than 90 degrees, and a bend radius at the position of the each ridgeline is from 0.1 mm to 30 mm.

5. The method for manufacturing a press-formed component according to claim 2, wherein a surface of the pad is provided with a second ridgeline at a position facing each of the ridgelines provided on the surface of the lower die, each second ridgeline extending in the same direction as each of the ridgelines provided on the surface of the lower die, and the surface of the pad having a shape following the facing surface of the lower die on both sides of the each second ridgeline.

6. The method for manufacturing a press-formed component according to claim 1, wherein the metal sheet is a high tensile strength steel sheet having a tensile strength of 590 MPa or more.

7. The method for manufacturing a press-formed component according to claim 3, wherein a difference between the surface inclinations on both sides of the each ridgeline is from 1 degree to less than 90 degrees, and a bend radius at the position of the each ridgeline is from 0.1 mm to 30 mm.

8. The method for manufacturing a press-formed component according to claim 3, wherein a surface of the pad is provided with a second ridgeline at a position facing each of the ridgelines provided on the surface of the lower die, each second ridgeline extending in the same direction as each of the ridgelines provided on the surface of the lower die, and the surface of the pad having a shape following the facing surface of the lower die on both sides of the each second ridgeline.

9. The method for manufacturing a press-formed component according to claim 4, wherein a surface of the pad is provided with a second ridgeline at a position facing each of the ridgelines provided on the surface of the lower die, each second ridgeline extending in the same direction as each of the ridgelines provided on the surface of the lower die, and the surface of the pad having a shape following the facing surface of the lower die on both sides of the each second ridgeline.

10. The method for manufacturing a press-formed component according to claim 7, wherein a surface of the pad is provided with a second ridgeline at a position facing each of the ridgelines provided on the surface of the lower die, each second ridgeline extending in the same direction as each of the ridgelines provided on the surface of the lower die, and the surface of the pad having a shape following the facing surface of the lower die on both sides of the each second ridgeline.

11. The method for manufacturing a press-formed component according to claim 2, wherein the metal sheet is a high tensile strength steel sheet having a tensile strength of 590 MPa or more.

12. The method for manufacturing a press-formed component according to claim 3, wherein the metal sheet is a high tensile strength steel sheet having a tensile strength of 590 MPa or more.

13. The method for manufacturing a press-formed component according to claim 4, wherein the metal sheet is a high tensile strength steel sheet having a tensile strength of 590 MPa or more.

14. The method for manufacturing a press-formed component according to claim 5, wherein the metal sheet is a high tensile strength steel sheet having a tensile strength of 590 MPa or more.

15. The method for manufacturing a press-formed component according to claim 7, wherein the metal sheet is a high tensile strength steel sheet having a tensile strength of 590 MPa or more.

16. The method for manufacturing a press-formed component according to claim 8, wherein the metal sheet is a high tensile strength steel sheet having a tensile strength of 590 MPa or more.

17. The method for manufacturing a press-formed component according to claim 9, wherein the metal sheet is a high tensile strength steel sheet having a tensile strength of 590 MPa or more.

18. The method for manufacturing a press-formed component according to claim 10, wherein the metal sheet is a high tensile strength steel sheet having a tensile strength of 590 MPa or more.

* * * * *